US005579020A

United States Patent [19]

Kinsey

[11] Patent Number: 5,579,020

[45] Date of Patent: Nov. 26, 1996

[54] LIGHTWEIGHT EDGE-SLOTTED WAVEGUIDE ANTENNA STRUCTURE

[75] Inventor: Richard R. Kinsey, Dewitt, N.Y.

[73] Assignee: Sensis Corporation, Dewitt, N.Y.

[21] Appl. No.: 371,138

[22] Filed: Jan. 11, 1995

Related U.S. Application Data

[63] Continuation-in-part of Ser. No. 126,599, Sep. 27, 1993, abandoned.

[51] Int. Cl.[6] ..... H01Q 13/00

[52] U.S. Cl. ..... 343/776; 343/771; 343/772; 333/248; 333/254

[58] Field of Search ..... 343/770, 771, 343/774, 776, 772; 333/248, 254; 52/720.1, 737.6, 726.2; 403/280, 281; H01Q 13/00

[56] References Cited

U.S. PATENT DOCUMENTS

| | | | |
|---|---|---|---|
| 2,981,907 | 4/1961 | Bundy | 343/771 |
| 3,523,297 | 8/1970 | Fee | 343/771 |
| 3,623,111 | 11/1971 | Provencher | 343/727 |
| 3,801,939 | 4/1974 | Lamy et al. | 333/254 X |
| 4,200,870 | 4/1980 | Gabbitas | 343/786 X |
| 4,229,745 | 10/1980 | Kruger | 343/771 |
| 4,243,990 | 1/1981 | Nemit et al. | 343/771 |
| 4,255,752 | 3/1981 | Noble et al. | 343/771 |
| 4,303,898 | 12/1981 | Kinsey et al. | 333/254 X |
| 4,353,072 | 10/1982 | Monser | 343/725 |
| 4,517,571 | 5/1985 | Mulliner et al. | 343/771 |
| 4,757,291 | 7/1988 | Spinner et al. | 333/254 |
| 4,785,304 | 11/1988 | Stern et al. | 343/771 X |
| 4,829,312 | 5/1989 | Terakawa et al. | 343/771 X |
| 4,952,894 | 8/1990 | Connemey et al. | 343/776 X |
| 5,126,705 | 6/1992 | Carnevali et al. | 343/853 X |
| 5,198,828 | 3/1993 | West et al. | 343/771 X |

FOREIGN PATENT DOCUMENTS

| | | | |
|---|---|---|---|
| 564853 | 10/1958 | Canada . | |
| 2319786 | 10/1973 | Germany | H01Q 13/22 |
| 2855280 | 7/1979 | Germany | H01Q 13/06 |
| 865367 | 8/1957 | United Kingdom . | |

*Primary Examiner*—Donald T. Hajec
*Assistant Examiner*—Steven Wigmore
*Attorney, Agent, or Firm*—Harris Beach & Wilcox, LLP

[57] ABSTRACT

A unitary waveguide element is employed in a light weight waveguide antenna. The waveguide element has a waveguide portion having a front wall with slots formed across it at predetermined locations, a continuous back wall, and substantially continuous broad walls. A first flange is formed on one of the broad walls lying in a plane that extends in the width direction. A pair of flanges are formed on the other broad wall that lie in planes that are displaced slightly from the first flange, so that when the waveguide element is superposed onto the next successive element, these flanges overlap with the second flanges straddling the first flange. The flanges are then bonded with epoxy or an equivalent agent. A rivet box is formed on the proximal side of the back wall and permits attachment of the waveguide element in precise alignment to a predrilled backing plate with rivets or other suitable fasteners. The rivets do not penetrate into the waveguide portion of the element.

12 Claims, 5 Drawing Sheets

LIGHTWEIGHT EDGE-SLOTTED WAVEGUIDE ANTENNA STRUCTURE

CROSS-REFERENCE TO RELATED APPLICATIONS

This application is a continuation-in-part of Ser. No. 08/126,599, filed Sep. 27, 1993 now abandoned.

BACKGROUND OF THE INVENTION

1. Field of the Invention

This invention relates to slotted waveguide antennas, and is more particularly directed to microwave antennas formed as an array of extruded waveguide elements.

2. Description of the Prior Art

Waveguide antennas are well known, and many have been proposed in which an array of waveguide elements each have slots in one face to serve as radiating or receiving elements. These antennas are configured in planar arrays, with up to one hundred lengths of waveguide stacked one on top of the other, and each of the waveguide elements having one hundred or more slots along its length. The waveguide elements are typically of rectangular cross section and are stacked together and mounted on a backing plate. The slots are cut on a face of the waveguide remote from the backing plate. The common practice is to form the waveguide elements with stiffener or reinforcing flanges along the broad walls. These can connect to one another and overlap, or can be attached to an additional support element on the backing plate. These flanges are typically positioned one quarter wavelength back from the slotted face, considering the band of wavelengths for which the antenna is designed. This creates a short circuit position between successive superposed waveguide elements at the quarter-wavelength distance.

Examples of prior art waveguide antennas are shown in U.S. Pat. No. 4,255,752 to Noble et al. and U.S. Pat. No. 4,517,571 to Mulliner. In addition, a lightweight antenna has been proposed which employs specially extruded waveguides with flanges both at the rear of each waveguide element and also at the quarter wavelength short-circuit position. The flanges of the rear of the waveguide are overlapped and riveted together. This produces a virtually self-supporting antenna face. This antenna is suitable for use with microwave frequencies below X-band and up to X-band, provided full height waveguide is employed. However, for reduced height waveguides and for frequencies at X-band and above, there is insufficient space between elements to accommodate rivets or other mechanical fasteners.

A self supporting multiband array antenna is proposed in Nemit et al., U.S. Pat. No. 4,243,990. Wherein a plurality of waveguide elements are spaced apart from a conductive backplate by spacers. However accurate prealignment of the elements with respect to one another and the backplate during fabrication of the array is not possible with this arrangement.

SUMMARY OF THE INVENTION

It is an object of this invention to provide a waveguide microwave array antenna of a simple improved construction and of light weight, having rigidly aligned elements at close tolerances to assure an accurate predetermined pattern of microwave radiation.

It is another object to provide a self supporting microwave array antenna for use in the X-band and higher frequencies, that is strong enough to withstand strong winds and extreme variations in temperature in a shipboard environment while maintaining its alignment.

In accordance with an embodiment of this invention, an extruded waveguide array has elements comprising a slotted front wall, a back wall, and two broad walls. Flanges or tabs are formed at the quarter wavelength location on the broad walls. The tabs include a single flange on one broad wall and a double tab on the other broad wall. The double tab straddles the single tab of the next adjacent waveguide element in the stack. The interleaved tabs are bonded together, e.g. with an epoxy, to form a rigid mechanical joint. The waveguide height is typically twice the space between waveguides, so there is greater room available in the rivet box than in the tabs to receive the rivet or other fastener.

In accordance with one aspect of the invention a rivet box is integrally formed on the back wall, which permits each waveguide element to be riveted to a pre-drilled backing plate without the rivet penetrating the waveguide cavity, and to secure a predetermined rigid alignment of the elements at very close tolerances.

In accordance with another aspect of the invention penetrations through the backplate for attachment of adjacent waveguide elements are staggered across a centerline therebetween to allow a greater density of rivets in applications where the size of the rivet head is large compared to the waveguide element interspaces.

The waveguide tabs provide a short circuit between elements at the quarter wavelength position, and this produces excellent cross-polarization suppression. The waveguide array, together with the backing plate and rivets, creates a lightweight, rigid structure. The backing plate can be very thin and lightweight, so the entire antenna structure does not weigh much more than the waveguide stack alone. This structure provides excellent performance where small waveguides are required, e.g. for higher microwave frequencies or in reduced height waveguide antennas where the array must be closely packed.

The above and many other objects, features, and advantages of this invention will become apparent from the ensuing description of a preferred embodiment, to be read in conjunction with the accompanying Drawing.

DESCRIPTION OF THE PREFERRED EMBODIMENT

Figure 1:
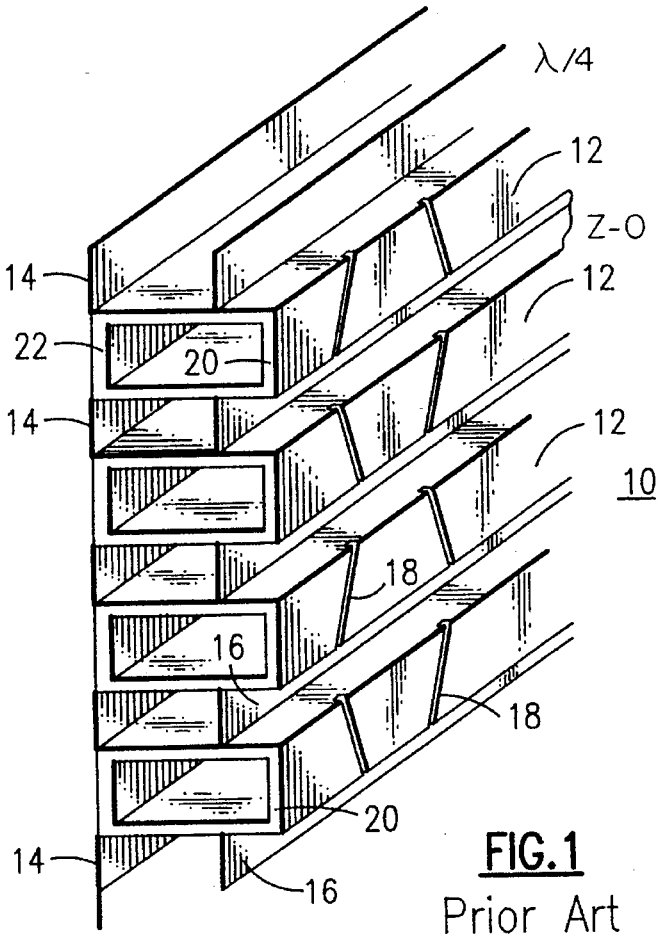
FIG.1 Prior Art
FIG. 1 is a perspective view of slotted waveguide array antenna of a prior art design.
Figure 2:
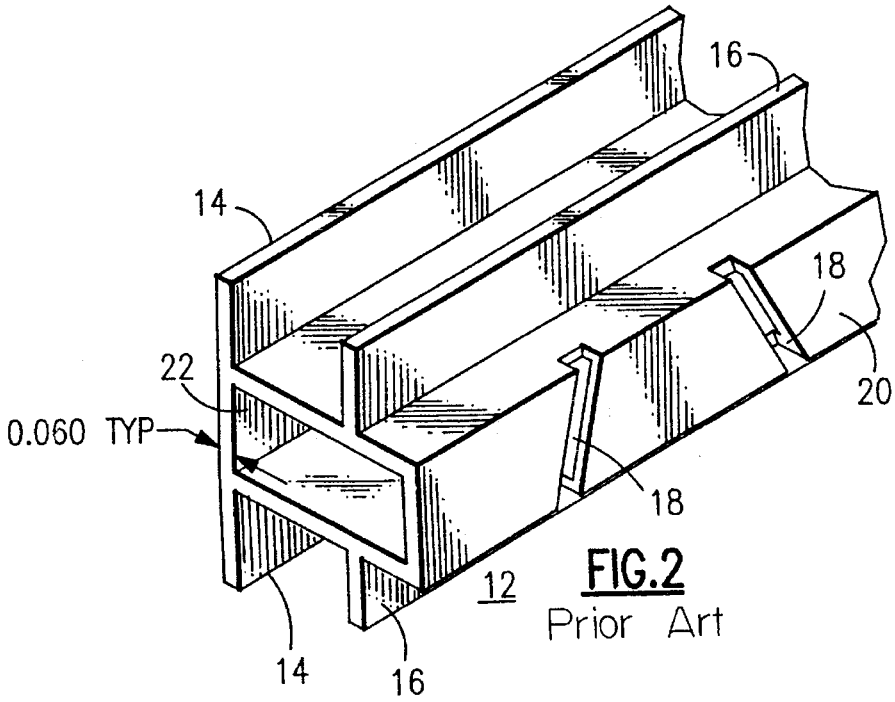
FIG.2 Prior Art
FIG. 2 is an enlarged detail view of the waveguide extrusion employed in the prior art antenna of FIG. 1.
Figure 3:
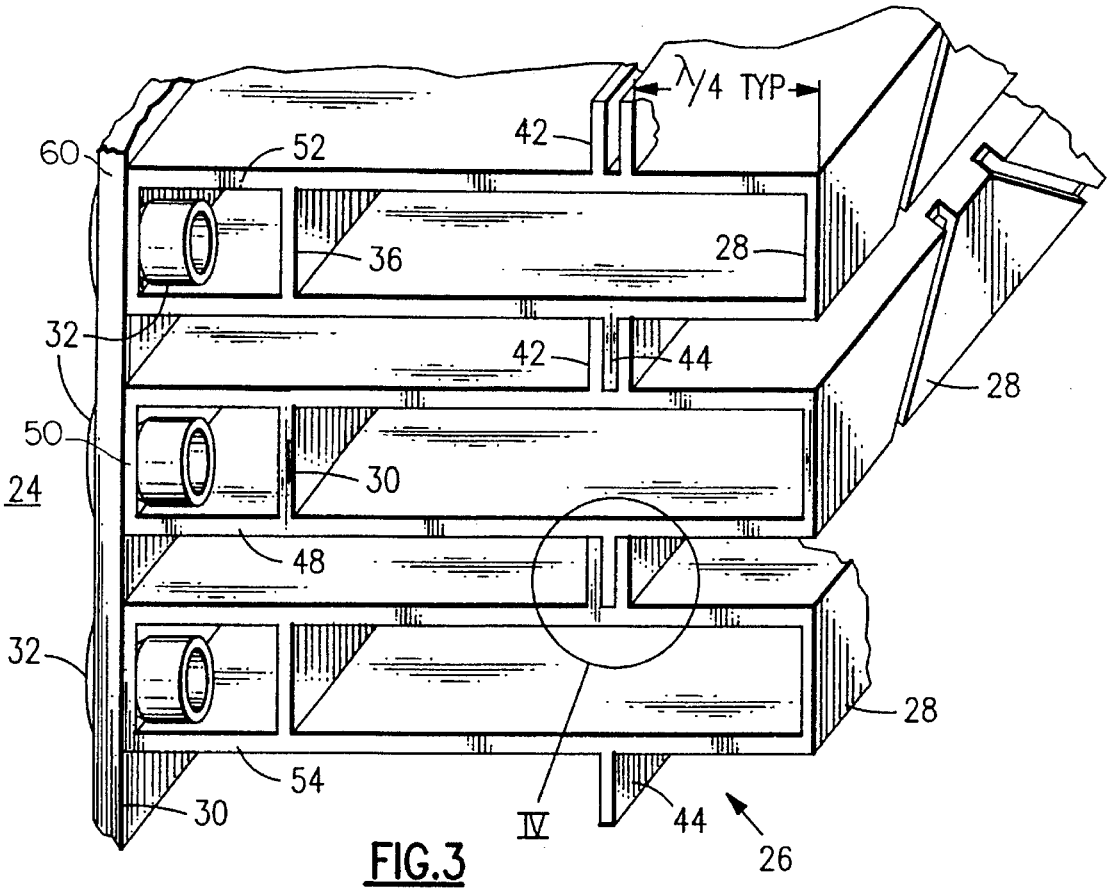
FIG. 3 is a perspective view of a slotted waveguide array antenna according to one embodiment of this invention.

With reference to the Drawing, FIGS. 1 and 2 show a prior-art construction of a edge-slotted waveguide antenna, which is presented here for purposes of contrast with the invention, so that the advantages of this invention will be more apparent.

A waveguide antenna is formed of an array of lengths of extruded waveguide 12, here as a stack of waveguide elements superposed on one another. The waveguide elements 12 have a pair of back flanges 14 and short circuit flanges 16 projecting above and below the waveguide element, and a plurality of slots 18 in a front wall 20 of the waveguide. The waveguide elements 12 also have a back wall 22 continuous with the flanges 14. The slots 18 are arranged at various predetermined angles, and extend across the front wall 20 and a short distance into a distal portion of the corresponding broad walls. In the array 10 shown in FIG. 1, the flanges 14 overlap with the corresponding flanges 14 of the superposed adjacent waveguide element 12, and the short circuit flanges 16 similarly overlap with the corresponding flanges 16 of the next superposed element 12. These flanges 14, 16 are riveted or otherwise fastened to one another to form a substantially rigid antenna unit. In this case the back plate can be omitted. Also, the array has to be at least a certain minimum size because the flanges 14, 16 have to be rather wide to accommodate rivets. This limits use of this type of antenna to wavelengths in the X-band and longer. For reduced-height waveguide or for frequencies at the X-band and above, there is insufficient space between the waveguide elements 12 to accommodate rivets or other standard mechanical fasteners.

The waveguide antenna according to one embodiment of this invention is illustrated in FIGS. 3–8. In this embodiment, there is an array 24 of waveguide members 26, here stacked one on top of the next. Each of the waveguide members 26 has a slotted front face 28, which can have the slots arranged in selected locations in a known manner.

Figure 4:
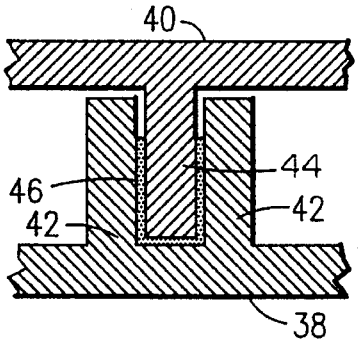
FIG. 4 is a detailed cross section illustrating the feature highlighted at IV in FIG. 3.

The rectangular waveguide cavity 34 is defined by the slotted front face 28, and a continuous back wall 36 extending parallel to it in the height direction. A continuous upper broad wall 38 and a continuous lower broad wall 40 run parallel to each other in the width direction. Double flange 42 extends upward from the upper broad wall 38 for a distance of about the height of the cavity 34, and a single flange 44 as shown in FIG. 4 extends downward the same distance from the lower broad wall 40. When the waveguide members 26 are superposed on one another, the double flange 42 straddles the single flange 44 of the next adjacent member 26, and these are affixed to one another using an epoxy 46 or equivalent material.

In this embodiment, the flanges 42, 44 combine to form a short circuit member at the location approximately one quarter wavelength from the front wall 28, considering the band of frequencies for which the waveguide is designed.

A rivet box 48 is integrally formed on the rear of the back wall 36. The rivet box consists of a rear wall 50 that is parallel to the back wall 36, and broad walls 52 and 54 which are extensions of the waveguide broad walls 38 and 40, respectively. A series of pre-drilled openings or penetrations 56 into the rear wall 50 permit insertion of the rivets 32 so that the waveguide members 26 can be installed and held in place on the backing plate 30.

A predrilled backing plate 60 provides support for the array 24, and the waveguide elements 26 are held onto the backing plate 60 by rivets 32, which can be so-called pop rivets (also known as blind rivets). The rivets 32 extend through predrilled penetrations 62 (FIG. 6) and through prepositioned penetrations 56 in the rear wall of 50 of the rivet box. The combination of the rivets 32 and the penetrations 56, 62 has two important functions; namely (1) imparting a high degree of structural strength and rigidity for the assembled waveguide antenna; and (2) securing each of the waveguide elements in a precise position and alignment, such that the radiation pattern of the antenna is known to a high degree of accuracy. Extremely close and stable positional tolerance for the waveguide elements 26 is essential for critical applications such as target surveillance.

In this embodiment, the waveguide height is approximately twice the height of the space between waveguides. There is relatively greater room in the rivet box 48 for adapting fastening hardware than is the case for the corresponding flanges 42, 44. The tabs or flanges 42 and 44 provide a short circuit between waveguide elements, which is desirable for cross polarization suppression. The epoxy 46 holds these together in a rigid joint. This mechanical self-reinforcing structure formed by the flanges 42, 44 together with the backing plate 60 and the rivets 32, produces a structural entity of a considerable stiffness with total weight not significantly greater than the weight of the waveguide elements 26 alone. Other fastening means can be substituted for the rivets, such as bolts, pins, screws and the like, so long as the waveguide cavity is not entered by the fastening means. This construction is well suited for small waveguide elements 26, which are required for the higher microwave frequencies i.e. X-band and above, and for reduced-height waveguide antennas where the elements are closely packed. This construction also works well for larger waveguides used at lower frequencies.

Figure 5:
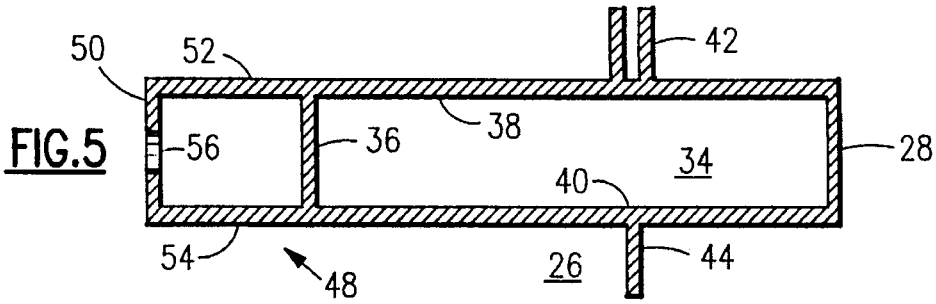
FIG. 5 is a cross section of the waveguide extrusion employed in this embodiment.
Figure 6:
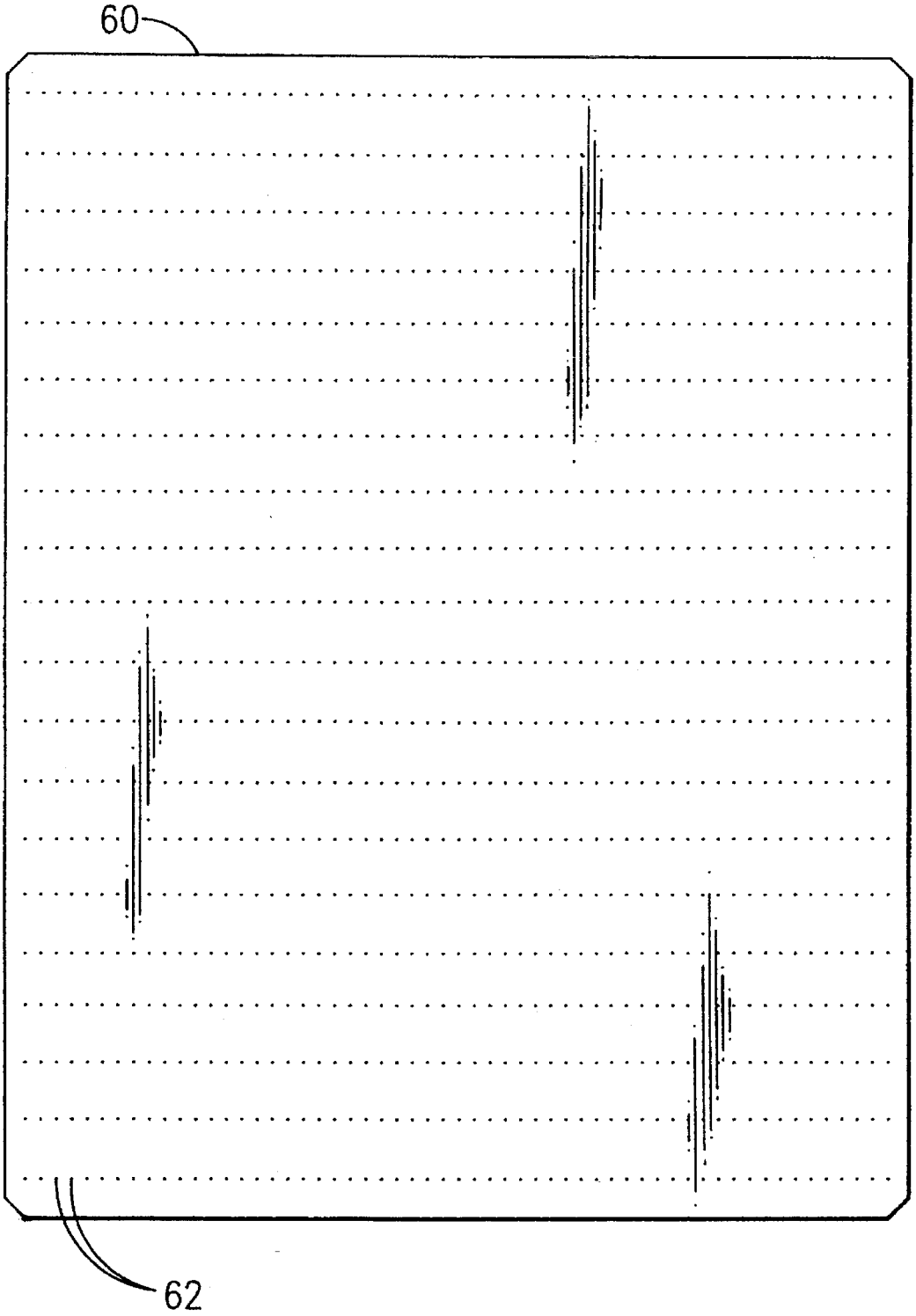
FIG. 6 is a diagram illustrating a backing plate pattern of pre-aligned penetrations.
Figure 7:
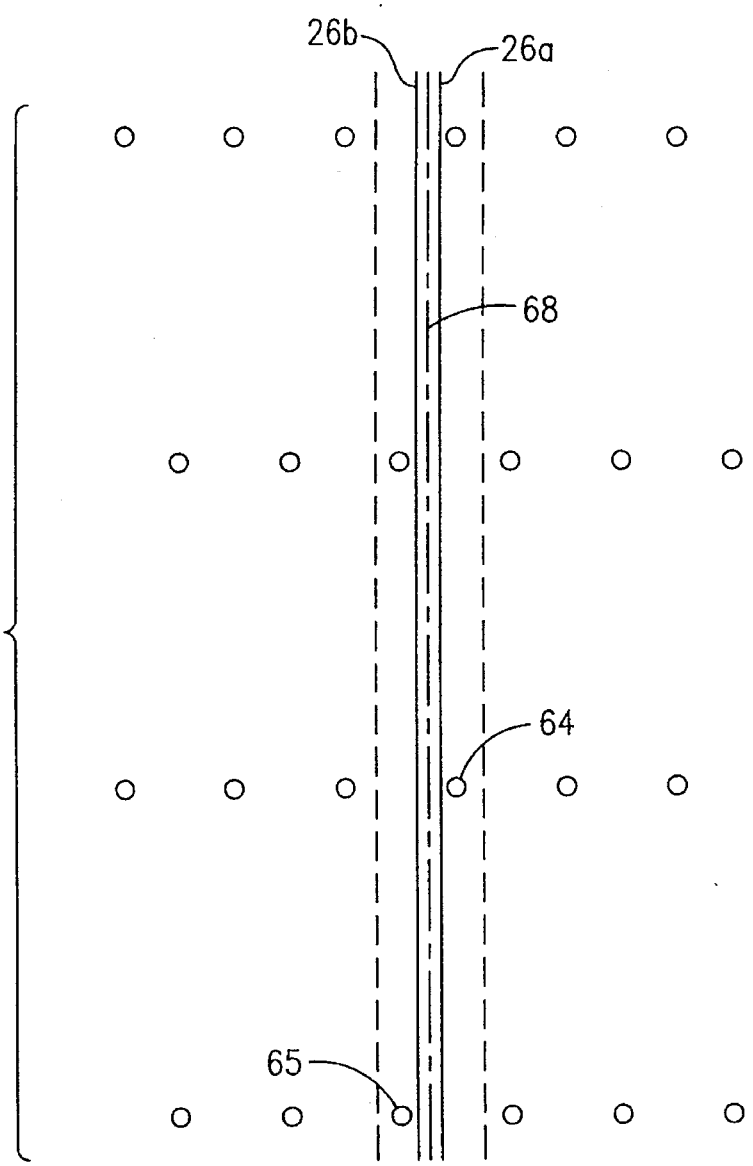
FIG. 7 is an enlarged view of the pattern shown in FIG. 6.

Turning now to FIGS. 6 and 7, there is shown a backplate 60 for an array antenna suitable for operation in the KU band. The backplate has a plurality of penetrations, such as 62—62, which are disposed in a predetermined pattern, and positioned at very close tolerances to receive the rivets 32 therethrough. The rivets 32 pass through predrilled holes 56 in the rear walls 50 of the rivet boxes (FIG. 5). In FIG. 7, there is shown a detailed view of a portion of the pattern of FIG. 6. Adjacent waveguide elements (shown vertically in FIG. 7) are spaced on 0.260 inch centers and secured by rivets spaced 3.000 inches apart along their length. The penetrations for waveguide elements occur at horizontal intervals of 0.520 inches, and penetrations to secure two neighboring waveguide elements, shown in phantom at reference numerals **26*a*, 26*b* are spaced apart by 1.500 inches, and adjacent penetrations 64, 65 for the waveguide elements 26*a* and 26*b* respectively are staggered at an offset of 0.130 inches on opposite sides of a center line 68**. The penetration diameters are 0.096 inches. All tolerances are +/–0.001 inches.

Figure 8:
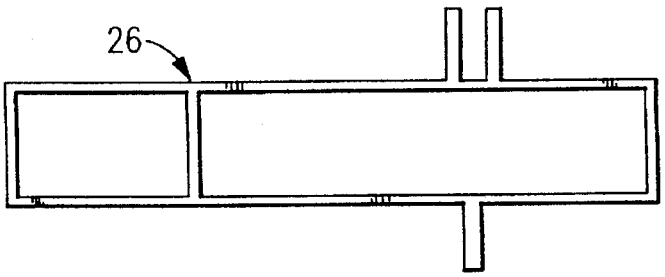
FIG. 8 is detailed sectional view of a waveguide extrusion according to the embodiment of FIG. 3.
Figure 9:
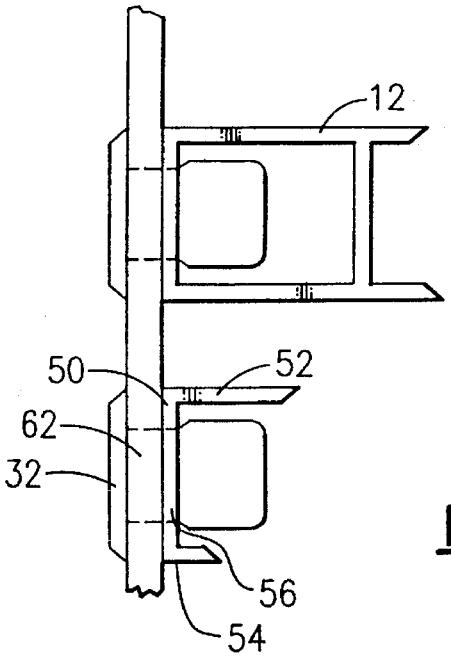
FIG. 9 indicates other dimensions of the various parts of a waveguide element 26 suitable for use in the KU band.

FIGS. 8 and 9 indicate other dimensions of the various parts of a waveguide element 26 suitable for use in the KU band.

Figure 10:
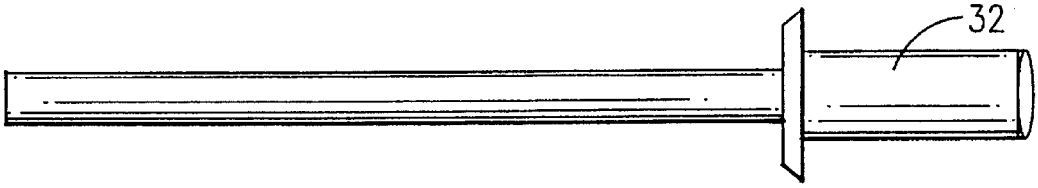
FIG. 10 illustrates an aluminum pop rivet 32 used in the embodiment of FIGS. 8 and 9.

FIG. 10 illustrates an aluminum pop rivet 32 that used in the embodiment of FIGS. 8 and 9. The rivet 32 is available from McMaster-Carr Supply Co. as Part No. 928b47A105.

Further details of the construction of the extruded waveguide elements 26 are given in table 1.

TABLE 1

| | |
|---|---|
| Material: | Aluminum 6061T6 |
| Internal Diameter tolerance | +/− 0.001 inches |
| Wall thickness | 0.015 inches nominal |
| Corner radii: | 0.010 inches maximum |
| Twist | 0.5 deg/ft maximum |
| Broadwall flatness | +/− 0.001 inches |
| Surface finish | 20 mil or better |
| Length | 6 ft nominal |

EXAMPLE 1: (ACCORDING TO INVENTION)

A test section of a linear array antenna was constructed in accordance with the above description, and had 10 waveguide elements uniformly spaced on 0.260 inch centers with a backing plate 0.062 inches thick. This structure weighed 3.276 pounds per square foot. The test section was simply supported with a span of 30.5 inches and an 8 pound load applied at the center. The measured deflection was 0.008 inches.

The deflection of the backplate alone, without the waveguides can be predicted from the formula.

$$\Delta = \frac{Wd^3}{48EI}$$

wherein

Δ is the measured deflection;

W is width;

d is length;

E is the modulus of elasticity; and

I is the moment of inertia.

and $$I = \frac{bh^3}{3}$$

wherein h is thickness; and b is width.

Applying these formulae to the above noted backplate yields:

$$\Delta = 8.0 \times \frac{30.5^3}{(10 \times 10^6) \times 48 \times I}$$

and $$I = \frac{(8.0)\,(30.5^3)}{(0.008)\,(10^7)\,48} = 0.05911$$

so that $$\Delta = 1.49''$$

EXAMPLE 2: (COMPARISON WITH STRUCTURAL HONEYCOMB)

This is a predictive example. A honeycomb structure designed with the same weight as the section of Example 1 was subjected to computer analysis to determine its deflection. The honeycomb has an thickness of 0.963" (external); and top and bottom skins, each measuring 0.106 inches, such that the structural weight is 3.276 pounds per square foot. The honeycomb construction is further detailed in the HEXCEL handbook, TSB-124, entitled *Bonded Honeycomb Sandwich Construction.* The computer software employed was *HEXCEL Bonded Sandwich Construction Design Computer Program*, Rev. 2.00, dated Sep. 5, 1989, and available from HEXCEL, 101 East Ridge Drive, Suite 102, Danbury CT 06810.

The predicted deflection of the honeycomb was 0.0056 inches.

It was further determined that a honeycomb structure having the same deflection as the waveguide test section of Example 1 would have the following structure:

| | |
|---|---|
| External thickness | 0.963 inches |
| Skin thickness (top & bottom) | 0.062 inches |
| Weight | 2.066 psf |

Otherwise stated, the waveguide test section of Example 1 weighs only 1.59 times as much as a honeycomb structure having the same deflection, or has only 1.43 times the deflection of a honeycomb structure having the same weight.

While this invention has been described in detail with respect to a preferred embodiment, it should be understood that the invention is not limited strictly to that embodiment. Rather, many modifications and variations would present themselves to those with skill in the art without departing from the scope and spirit of this invention as defined in the appended claims.

What is claimed is:

1. An integrated planar microwave array antenna for use in the X-band and higher frequencies, comprising:

a backplate having a plurality of preformed penetrations therethrough, said penetrations being disposed in a predetermined pattern;

a plurality of spaced apart extruded waveguide elements, each having a fenestrated front wall, a back wall, a first broad wall, and a second broad wall, said walls defining an elongated cavity having a generally rectangular cross-section for passage of microwave energy therealong, a height dimension of said cavity being defined by said first broad wall and said second broad wall, said broad walls of said plurality of waveguide elements all being disposed in mutually parallel alignment; a rivet compartment being formed on each said back wall, said compartment including a rear wall having a plurality of bores therethrough that align with said penetrations of said backplate; and rivet means extending through said preformed penetrations of said backplate and said bores of said rivet compartments for attaching said waveguide elements in precise mutual alignment to said backplate, wherein said rivet means are excluded from said elongated cavities of said waveguide elements.

2. The antenna according to claim 1, wherein a width dimension of an interspace separating two neighboring waveguide elements is less than said height dimension of said elongated cavity.

3. The antenna according to claim 1, further comprising:

a first flange disposed on an exterior surface of said first broad wall;

two second flanges disposed on an exterior surface of said second broad wall, each of said second flanges being displaced from said first flange in an opposite direction, said first flange of a said waveguide element interleaving with said second flanges of a neighboring waveguide element.

4. The antenna according to claim 3, further comprising means for bonding said interleaved first and second flanges together.

5. The antenna according to claim 1, wherein said front wall has at least one slot formed therein.

6. The antenna according to claim 1, wherein said rivet means comprises a pop rivet.

7. A method of constructing an integrated planar microwave array antenna for use in the X-band and higher frequencies, comprising the steps of:

preforming a plurality of penetrations through a backplate in a predetermined pattern;

extruding a plurality of waveguide elements, each having a front wall, a back wall, a first broad wall, and a second broad wall, said walls defining an elongated cavity having a generally rectangular cross-section for passage of microwave energy therealong, a height dimension of said cavity being defined by said first broad wall and said second broad wall, a rivet compartment being established on each said back wall, said rivet compartment including a rear wall having a plurality of bores therethrough;

spacing said waveguide elements apart a predetermined distance;

aligning said broad walls of said plurality of waveguide elements in mutually parallel alignment;

aligning said bores of said rivet compartments with said penetrations of said backplate;

riveting said backplate to said rivet compartments through said preformed penetrations of said backplate and said bores of said rivet compartments, whereby said waveguide elements are attached in a precise predetermined alignment to said backplate; and while said step of riveting is being performed, excluding rivets from said elongated cavities of said waveguide elements.

8. The method in accordance with claim 7, further comprising the steps of:

during said step of extruding forming a first flange on an exterior surface of said first broad wall that extends perpendicular thereto; and forming two second flanges on an exterior surface of said second broad wall in planes that are parallel to a plane of said first flange, each of said second flanges being displaced from said first flange in an opposite direction;

interleaving said first flange of a said waveguide element with said second flanges of another waveguide element; and bonding said interleaved flanges together.

9. The method in accordance with claim 7, wherein said step of riveting is performed with pop rivets.

10. The method in accordance with claim 7, further comprising the step of forming a slot in said front wall of said waveguide elements.

11. The method in accordance with claim 7, wherein said predetermined distance is less than a height dimension of said cavity that is defined by said first broad wall and said second broad wall.

12. An integrated planar microwave array antenna for use in the X-band and higher frequencies, comprising:

a backplate having a plurality of preformed penetrations therethrough, said penetrations being disposed in a predetermined pattern;

a plurality of spaced apart extruded waveguide elements, each having a slotted front wall having at least one opening therein, a back wall, a first broad wall, and a second broad wall, said walls defining an elongated cavity having a generally rectangular cross-section for passage of microwave energy therealong, a height dimension of said cavity being defined by said first broad wall and said second broad wall, said broad walls of said plurality of waveguide elements all being disposed in mutually parallel alignment; a rivet compartment being formed on each said back wall, said rivet compartment including a rear wall having a plurality of bores therethrough that align with said penetrations of said backplate, wherein a width dimension of an interspace separating two neighboring waveguide elements is less than said height dimension;

pop rivets extending through said preformed penetrations of said backplate and said bores of said rivet compartments for attaching said waveguide elements in precise mutual alignment to said backplate, wherein said pop rivets are excluded from said elongated cavities of said waveguide elements;

a first flange disposed on an exterior surface of said first broad wall and extending perpendicular thereto; and two second flanges disposed on an exterior surface of said second broad wall in planes that are parallel to a plane of said first flange, each of said second flanges being displaced from said first flange in an opposite direction, said first flange of a said waveguide element interleaving with said second flanges of another waveguide element and being bonded thereto.

* * * * *